US009447662B2

(12) United States Patent
Johnson et al.

(10) Patent No.: US 9,447,662 B2
(45) Date of Patent: Sep. 20, 2016

(54) ABANDONMENT AND CONTAINMENT SYSTEM FOR GAS WELLS

(71) Applicant: HALLIBURTON ENERGY SERVICES, INC., Houston, TX (US)

(72) Inventors: Michael Johnson, Lafayette, LA (US); Blake Arabie, Lafayette, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/235,889

(22) PCT Filed: Mar. 4, 2013

(86) PCT No.: PCT/US2013/028926

§ 371 (c)(1),
(2) Date: Jan. 29, 2014

(87) PCT Pub. No.: WO2014/137314

PCT Pub. Date: Sep. 12, 2014

(65) Prior Publication Data

US 2016/0024896 A1 Jan. 28, 2016

(51) Int. Cl.

| | |
|---|---|
| ***E21B 43/10*** | (2006.01) |
| ***E21B 33/128*** | (2006.01) |
| ***E21B 33/13*** | (2006.01) |
| ***E21B 33/12*** | (2006.01) |
| ***E21B 34/12*** | (2006.01) |
| *E21B 34/00* | (2006.01) |

(52) U.S. Cl.

CPC ..... *E21B 43/108* (2013.01); *E21B 33/12* (2013.01); *E21B 33/128* (2013.01); *E21B 33/13* (2013.01); *E21B 34/12* (2013.01); *E21B 2034/007* (2013.01)

(58) Field of Classification Search

CPC ..... E21B 33/13; E21B 34/12; E21B 43/108; E21B 33/1208

See application file for complete search history.

(56) References Cited

U.S. PATENT DOCUMENTS

| | | | | |
|---|---|---|---|---|
| 4,869,323 | A | 9/1989 | Stagg | |
| 6,648,075 | B2 | 11/2003 | Badrak et al. | |
| 7,117,957 | B2 * | 10/2006 | Metcalfe | B21D 17/04 166/208 |
| 7,225,880 | B2 | 6/2007 | Braddick | |
| 7,441,606 | B2 | 10/2008 | Maguire | |
| 8,327,933 | B2 | 12/2012 | Mynde et al. | |
| 8,393,389 | B2 * | 3/2013 | Brisco | E21B 34/14 166/208 |
| 2003/0173092 | A1 * | 9/2003 | Wilson | E21B 33/134 166/387 |
| 2005/0241834 | A1 * | 11/2005 | McGlothen | E21B 41/0035 166/380 |
| 2008/0257560 | A1 * | 10/2008 | Brisco | E21B 34/14 166/377 |

(Continued)

OTHER PUBLICATIONS

International Search Report dated Nov. 13, 2013 for Application No. PCT/US2013/028926.

(Continued)

*Primary Examiner* — Shane Bomar

(74) *Attorney, Agent, or Firm* — Haynes and Boone, LLP

(57) ABSTRACT

The invention presents a method for plugging and abandoning spent wells. An expandable liner hanger having sealing elements positioned thereon, is run-in and expanded, creating at least one seal against fluid migration. A redundant seal is created using a swellable annular sealing device, such as a swell packer. The swell packer and liner hanger are run-in and expanded. A bottom valve is closed and the expansion and running tools released from the liner hanger. After pulling out of the running tool, the wellbore is cemented creating an effective plug.

10 Claims, 9 Drawing Sheets

(56) References Cited

U.S. PATENT DOCUMENTS

2014/0083702 A1* 3/2014 Godfrey ..... C09K 8/422
166/295
2014/0345876 A1* 11/2014 Coon ..... E21B 34/14
166/373

OTHER PUBLICATIONS

Written Opinion dated Nov. 13, 2013 for Application No. PCT/US2013/028926.

* cited by examiner

ABANDONMENT AND CONTAINMENT SYSTEM FOR GAS WELLS

FIELD

This application relates generally to methods and apparatus for hydrocarbon gas containment for well abandonment and more specifically to methods and apparatus for providing redundant sealing against fluid and gas migration in plugged and abandoned wells.

BACKGROUND

The present invention relates to cementing operations and, more particularly, to plug-and-abandon operations. In the process of drilling and completing hydrocarbon wells, it is common place to use heavy steel casing in a well and to place cement between the casing and the borehole to anchor the casing in place and prevent migration of fluids along the annulus outside the casing. After an upper portion of a well has been drilled and casing is cemented in place, it is common to resume drilling the well and install a liner in the lower part of the well by lowering the liner through the upper-cased portion of the well. Liner hangers are used to mechanically support the upper end of the liner, typically at the lower end of the previously set casing, and to seal the liner to the casing. Traditional liner hangers include slips for mechanical support of the liner and packers for forming a seal between liner and casing.

Expandable liner hangers are now commonly used in wellbore operations and provide advantages over traditional methods. These liner hangers are expanded against the wall of the previously set casing, such as those sold under the trade name VERSAFLEX, by Halliburton Energy Services, Inc., have been developed. Expandable liner hangers provide both mechanical support and a fluid seal by use of a number of annular seals, typically elastomeric rings, carried on the exterior of the expandable liner. In operation, the liner hanger is positioned in a cased portion of a well, and an expansion device is forced through the liner hanger to radially expand the liner hanger toward or into the casing wall, compressing the elastomeric seals to provide both mechanical, bidirectional support and a fluid seal.

At the conclusion of the life of the well, the well must be plugged and abandoned. In performing plug-and-abandon operations, a plugging composition (e.g., Portland cement, kiln dust, fly ash, slag cement, shale, etc.) is placed in the well at a desired depth. The plugging cement is pumped or circulated into the well, where it sets, forming a hardened mass (e.g., a plug) that seals off selected intervals of the well. The plug prevents or reduces zonal communication and migration of fluids that may contaminate water formations. This also prevents the migration of gas or fluids to the surface. It may be desirable to form plugs adjacent to hydrocarbon-producing formations and water-containing formations.

The number of hydrocarbon fields approaching the end of their lifespan is rapidly increasing. It is estimated that approximately 30,000 wells worldwide will have to undergo plugging and abandonment within the next fifteen years. Approximately 30% of these wells are subsea wells. In the North Sea alone, for example, it is estimated that about 6,000 wells will be subjected to plug and abandonment including 1,400 subsea wells, depending on aging profiles. In Asia, the average subsea well is over five years old. In Malaysia, 70-80% of the subsea wells are mature and on average 20-25 years old. Wells passing maturity in the Gulf of Mexico is also rapidly growing.

With the increase in concern and regulation regarding potential environmental impact of abandoned wells, improved methods and apparatus are desired for plugging and abandoning wells and insuring the integrity of the plugs. In some instances, plugs are compromised or casing deflected after completion of the P&A operation. Traditional liner hangers, mechanical packers, and the like, tend to have little ability to deform in response to these changes and practically no ability to further autonomously expand after the initial setting.

Traditional methods of plugging and abandoning subsea wells require use of expensive and slower heavy-duty and conventional rigs. It is desirable, therefore, to plug and abandon wells using lightweight and riserless well intervention with a consequent drop in expense and mobilization times. Further, the fleet of vessels suitable for such operations is larger than the available heavy-duty and conventional fleet. The lightweight and riserless intervention approach addressed herein provides a versatile solution to plug and abandonment operations offshore. It covers all aspects of the operation, from initial logging and inspection to plugging.

SUMMARY

Without limiting the invention in any way, this summary is provided for reference. In aspects, the present disclosure provides a tool string having an expandable liner hanger, a swellable packer, and a positive closing valve system for the purpose of providing a redundant gas tight seal for maintaining gas containment during P&A activities. The assembly is an expandable liner hanger with a swellable packer suitable for the specific application attached to the liner hanger. Attached below the swellable packer is a pressure balanced valve, that is pushed by a mandrel adapter on the liner hanger running tool into a positively closed position. The valve is contained within an assembly that attaches to the bottom of the swellable packer assembly.

The system is conveyed to setting depth on drill pipe with the bottom valve open. Upon reaching setting depth, an actuating fluid, such as diesel fuel, is "spotted" around the end of the assembly, forming a balanced volume of diesel fuel around the swellable annular sealing device, preferably a swell packer. The liner hanger is then expanded and set against the casing, for example, by dropping and seating a ball in the assembly and then increasing tubing pressure to drive a piston assembly which, in turn, drives an expansion element such as a cone. The radial expansion of the liner hanger forces annular sealing elements carried on the liner hanger to contact the casing, thereby creating a seal against fluid migration along the wellbore annulus. An over-pull test can confirm anchoring of the liner hanger. Weight is applied to release the running tool from the liner hanger and to close the bottom valve, preferably with a tool mandrel. As the running tool is retracted, the valve remains in the closed position. A locking mechanism, such as a snap ring or the like, can be used to lock the sleeve in the open position. The swellable packer radially expands upon contact with the actuating fluid and creates a redundant annular seal with the casing, sealing against gas migration.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF PREFERRED EMBODIMENTS

Figure 1A:
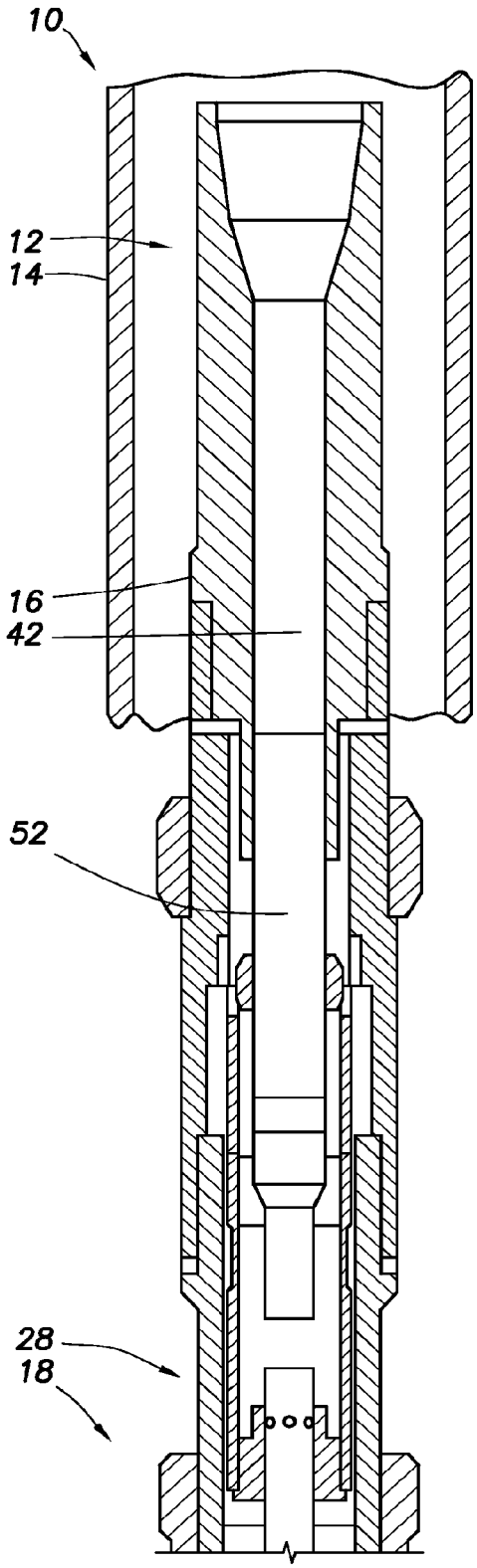
FIGS. 1A-G are cross-sectional, elevation views of an exemplary embodiment of a plugging and abandoning system according to an aspect of the invention positioned in a wellbore.
Figure 2A:
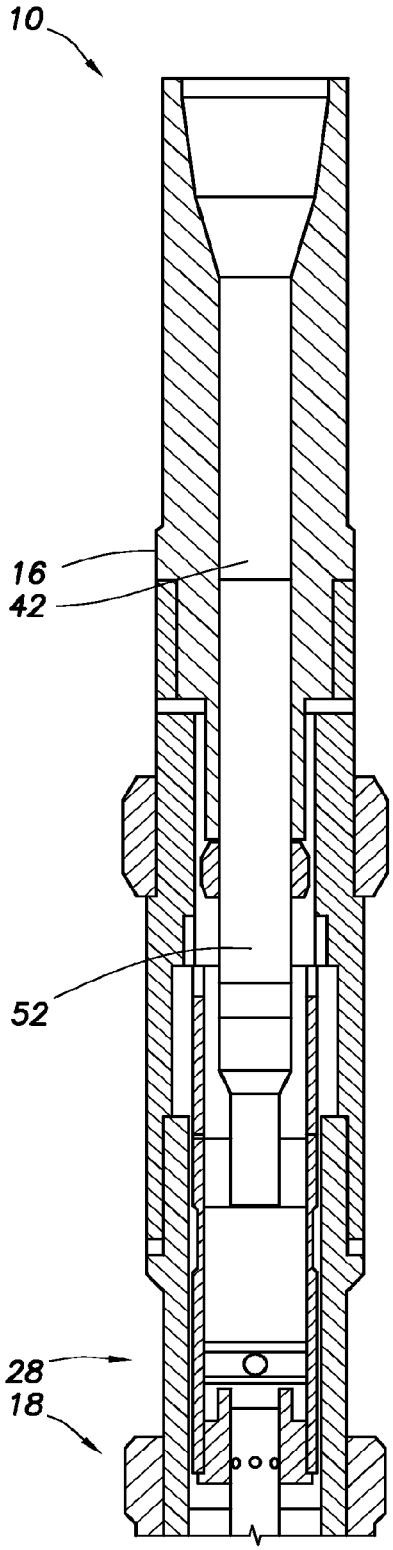
FIGS. 2A-G are cross-sectional, elevation views of the system of FIG. 1 with the valve assembly in a closed position.
Figure 1B:
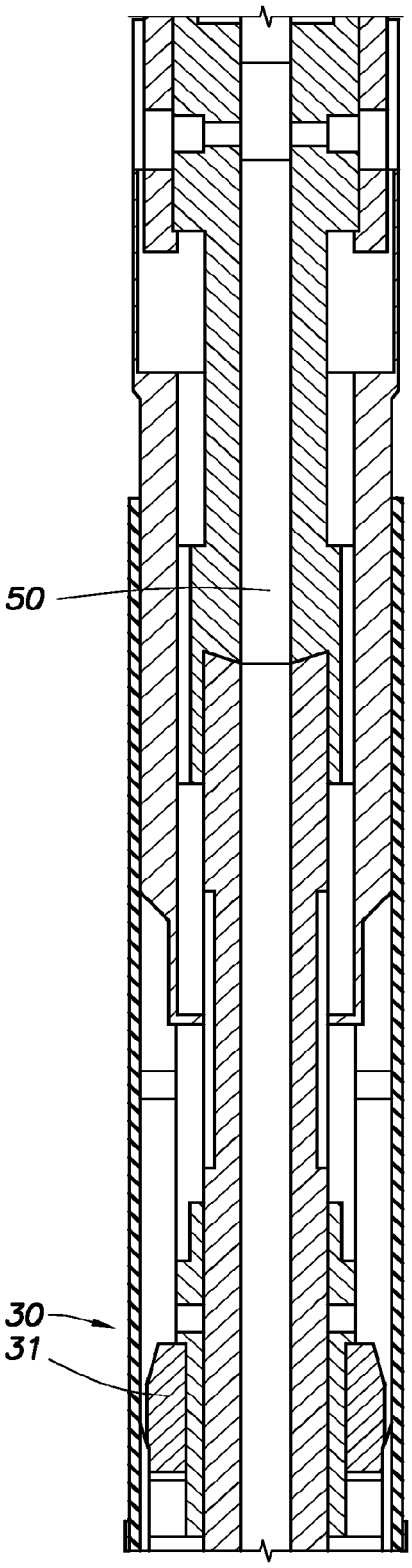
Figure 2B:
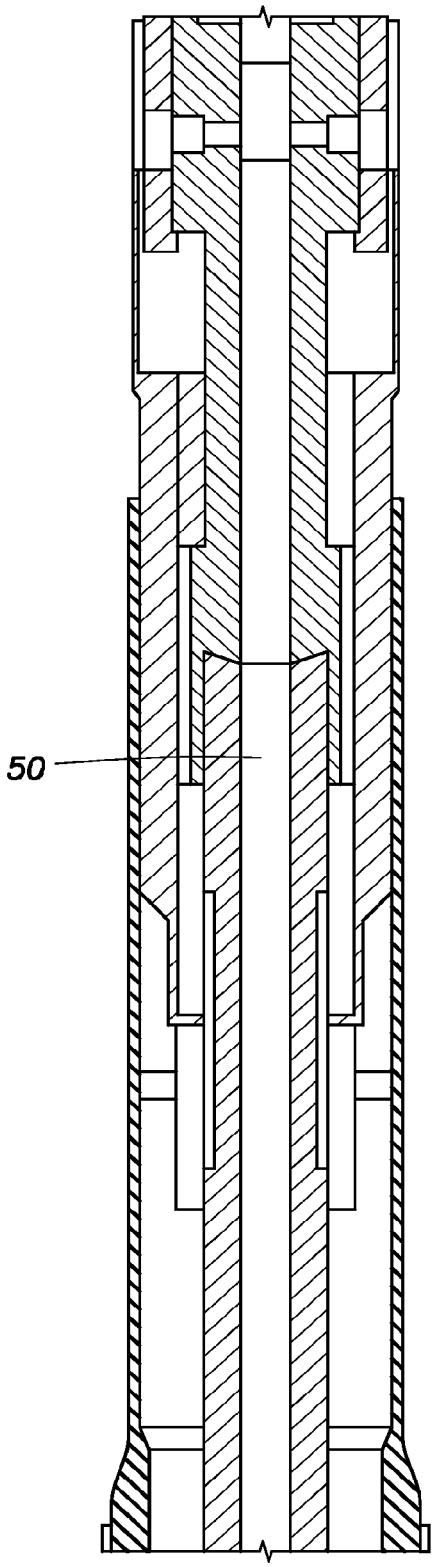
Figure 1C:
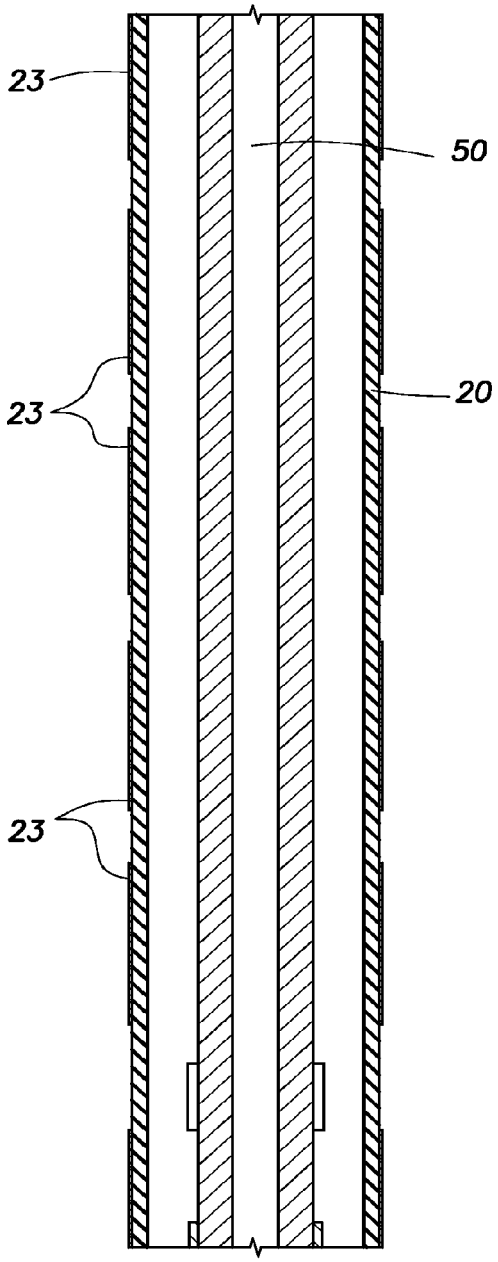
Figure 2C:
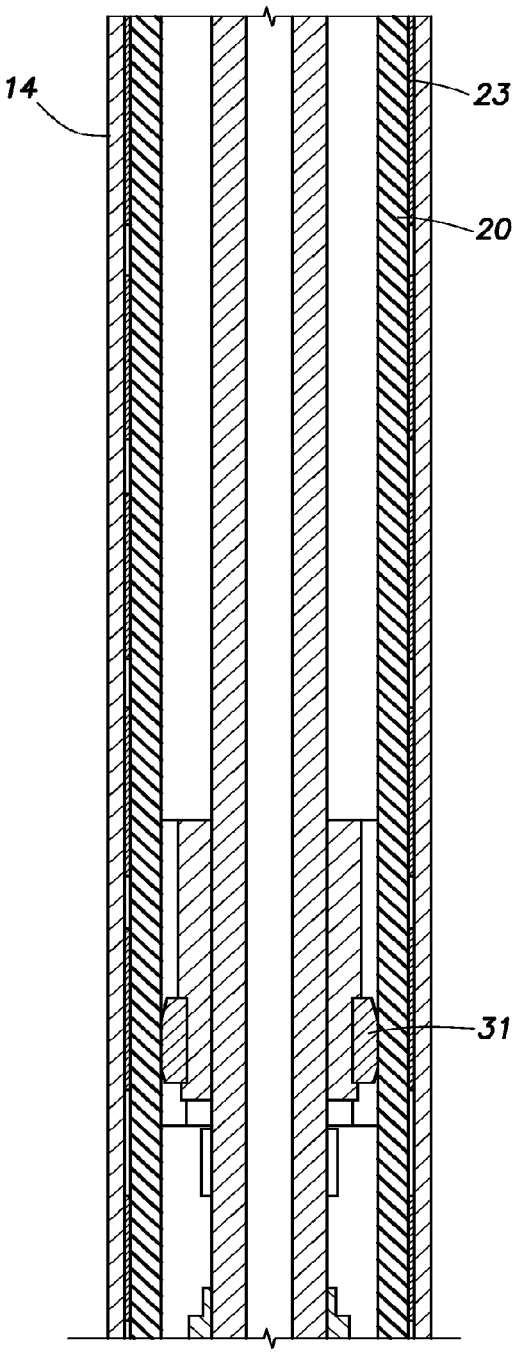
Figure 1D:
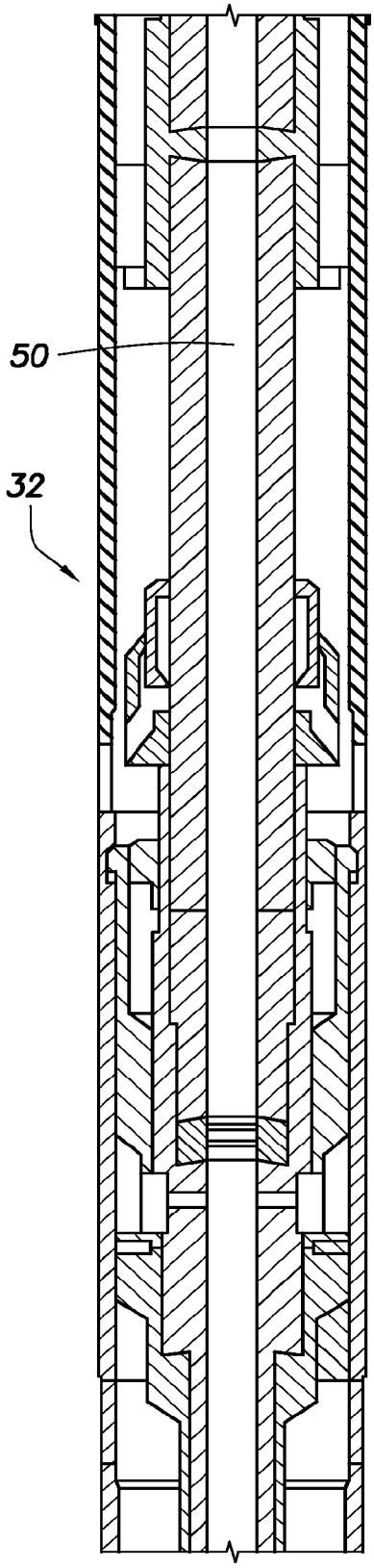
Figure 2D:
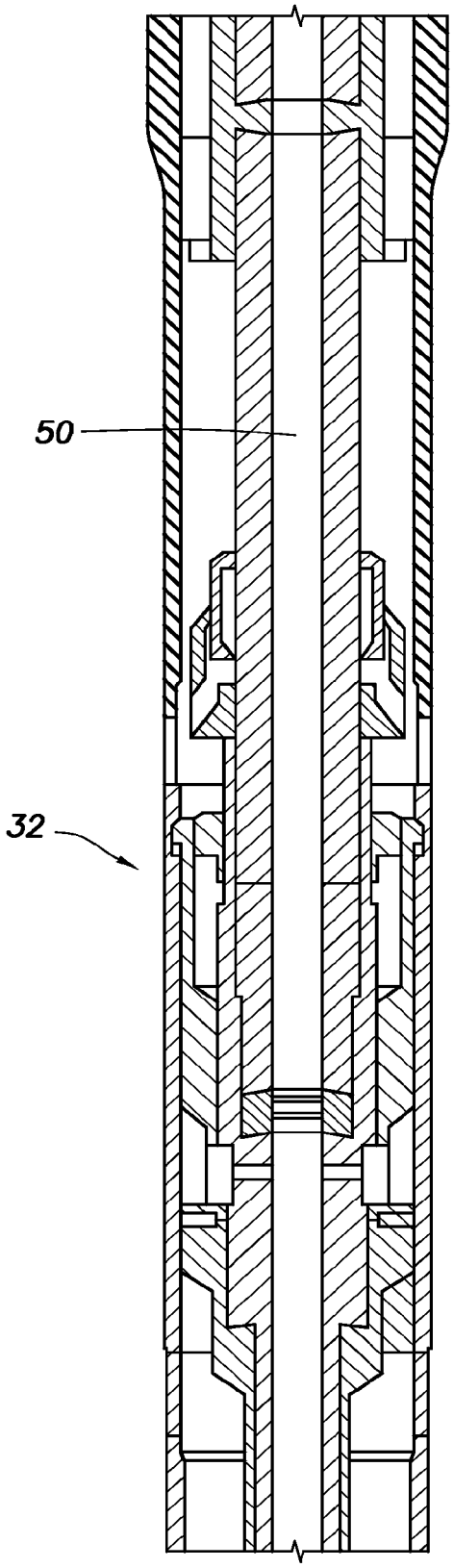
Figure 1E:
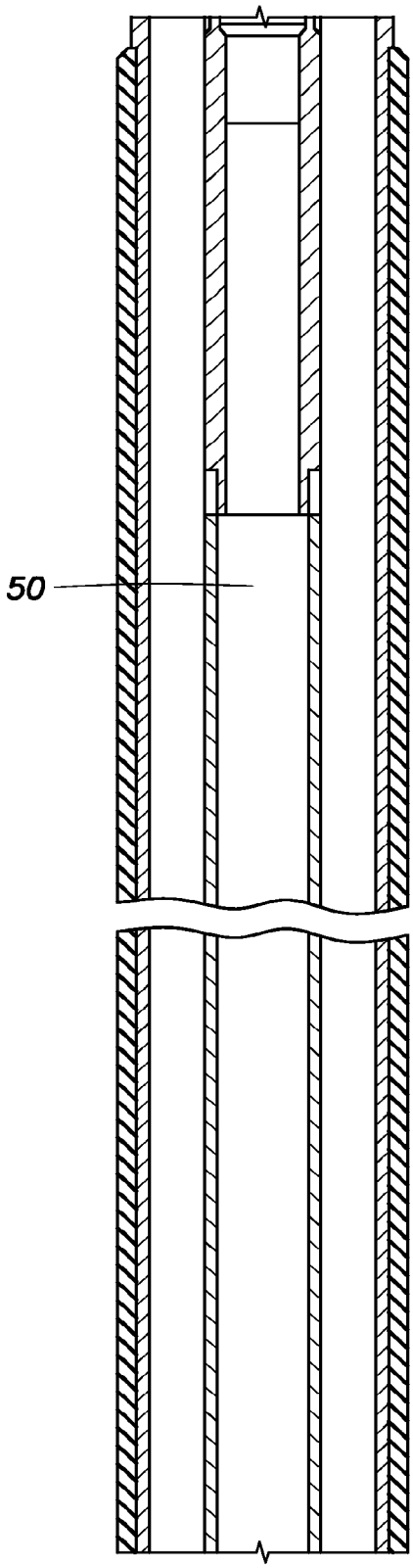
Figure 2E:
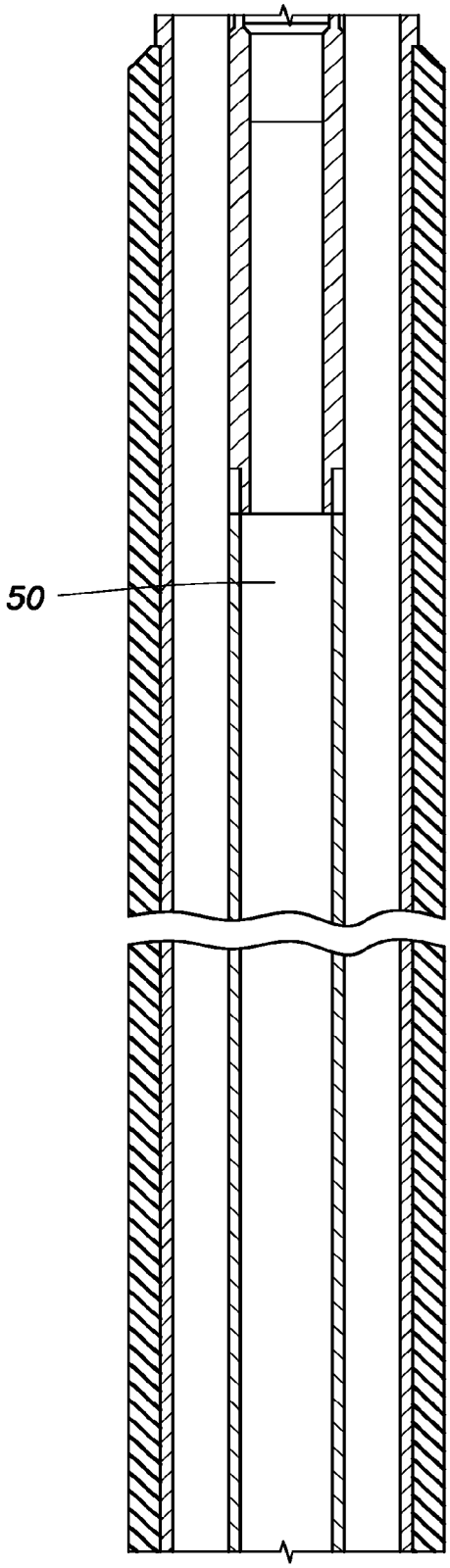
Figure 1F:
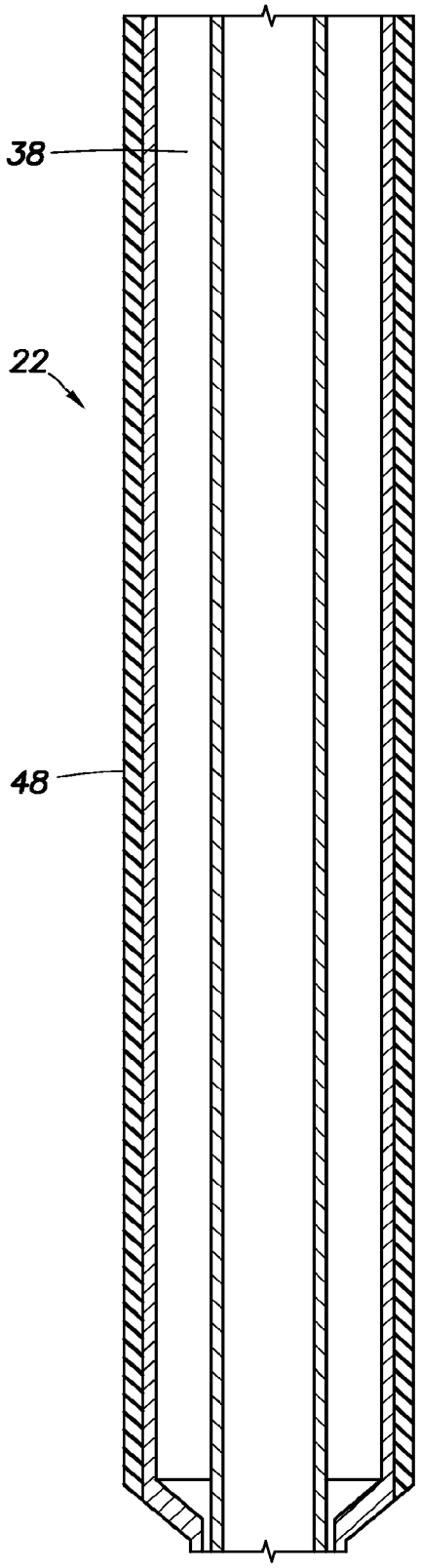
Figure 2F:
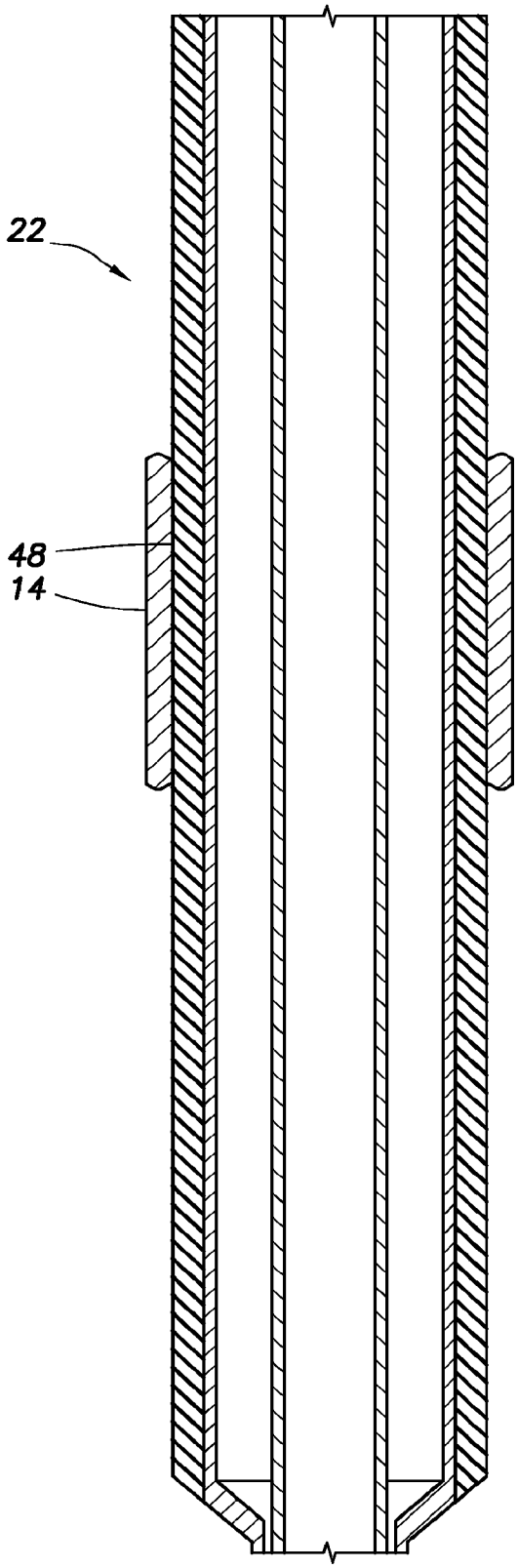

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments. In the following description of the representative embodiments of the invention, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

The description is provided with reference to a vertical wellbore; however, the inventions disclosed herein can be used in horizontal, vertical or deviated wellbores. As used herein, the words "comprise," "have," "include," and all grammatical variations thereof are each intended to have an open, non-limiting meaning that does not exclude additional elements or steps. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized.

FIGS. 1A-G are cross-sectional, elevation views of an exemplary embodiment of a plugging and abandoning system according to an aspect of the invention positioned in a wellbore. FIGS. 2A-G are cross-sectional, elevation views of the system of FIG. 1 with the valve assembly in a closed and locked position. The Figures will be discussed together.

A tool string 10 is presented positioned in a wellbore 12 having a casing 14. The string 10 includes an upper sub 16 connected to a tubing string (not shown), a liner hanger running tool 18, an expandable liner hanger assembly 20, a swellable annular sealing device 22, such as a swell packer, a bottom valve assembly 24, and an end cap 26. The tool string is run-in to the wellbore according to well-known methods and positioned properly for setting in the wellbore at a desired downhole location.

The exemplary liner hanger running tool 18 preferably has a setting tool assembly 30 utilizing one or more expansion cones 31, hydraulically actuated pistons, etc., a releasable connector assembly 32, setting sleeve, expandable liner hanger 20, and other operable parts, such as cross-over tools, at 28, which will be understood by practitioners of the art and are common in the field. The expandable liner hanger, running tool, expansion and setting assembly, and methods of use, etc., will not be discussed herein in detail. For disclosure related to systems for expanding liner hangers, see, for example, U.S. Pat. No. 7,779,910, to Watson, issued Aug. 24, 2010, which discusses a piston-driven, expansion cone having a first outer diameter when driven through the expandable liner hanger in a first direction to expand the expandable portion of the liner. For disclosure relating to setting tools for expandable liner hangers and associated methods, see, for example, U.S. Pat. No. 8,100,188, to Watson, issued Jan. 24, 2012. For disclosure regarding an expandable liner, expansion cone setting tool, and method, see U.S. Pat. No. 8,261,842, to Moeller, issued Sep. 11, 2012. A setting tool is disclosed in U.S. Patent Application Pub. 2012/0186829, to Watson. A running tool for expandable liner hanger is disclosed in U.S. Patent Application Pub. 2008/0257560 to Brisco. Liner string installation is described in U.S. Patent Application Pub. 2011/0132622 to Moeller. An expansion cone assembly for setting a liner hanger is disclosed in U.S. Patent Application Pub. 2012/022868 to Hazelip. An entry guide for a liner hanger is disclosed in U.S. Patent Application Pub. 2012/0125635 to Watson. Each of the foregoing references are hereby incorporated herein in their entirety for all purposes including support for the claims appended hereto.

The setting tool and expansion cone assembly are operable to radially expand the liner hanger 20 along its length. The setting tool can be actuated by hydraulic pressure applied from the surface by the user, such as by increasing tubing pressure, or by other means known in the art. The setting tool includes piston assemblies to convert hydraulic pressure into mechanical movement of the expansion cone.

The liner hanger 20 has mounted or positioned on its exterior one or more annular sealing elements 23. The sealing elements are preferably elastomeric material, which is known in the art, as are acceptable substitutes. The sealing elements 23, when the liner hanger is radially and plastically expanded by the expansion tool, are radially expanded into contact with the casing, creating one or more annular, fluid-tight, seals between the casing and tubular. This system of annular sealing for purposes of hanging liners is known in that art, available on commercial tools such as the Halliburton VersaFlex (trade name) ELH system, and further disclosure can be found in the references incorporated herein.

The sealing provided by the liner hanger sealing elements 23 form the "first seal" against gas or fluid migration. (Note that the term "first" is used merely for identification and does not require, and is not intended to imply, that the first seal is formed prior to formation of a second seal, positioned above or below a second seal, or provides a more or less effective seal than a second seal.) The expandable liner hanger provides mechanical support for the liner hanger, swellable device, valve assembly and end cap, effectively suspending them in the well by the casing.

In operation, the liner hanger is positioned in a cased portion of a well and an expansion device, such as expansion cone 31, is forced through the liner hanger to radially expand the liner hanger toward or into the casing wall, thereby also compressing the elastomeric seals 23 against the casing. The expanded liner hanger provides both mechanical support and a fluid seal.

A mandrel 50 is positioned within the assembly, extending from the valve assembly 24 at the bottom of the system to a mandrel adapter 52 positioned in the running tool 18. The mandrel lower end 54 is positioned adjacent to the valve assembly 24 and operates to move the valve assembly from an open to a closed position. More particularly, the lower end 54 of the mandrel, when moved downward, moves the valve sleeve 40 downward, thereby covering and blocking flow through radial ports 44.

Attached to the liner hanger running tool 18 is a swellable, annular sealing device 22. In a preferred embodiment the device is a swellable packer selected based on the particular application. Preferably the swellable sealing device has a support tubular 38 underlying an exterior sleeve 48 of swellable material. The tubular 38 may have a radially expanded portion, as shown. Swellable materials for use in downhole applications are known in the art and will not be discussed in detail herein. The swellable material is positioned in the tubular such that, upon expansion, the swellable material creates a fluid tight seal in the annulus between the casing and tool assembly. The seal provided by the swellable, annular sealing device 36 may be referred to herein as the "second seal" and forms a redundant seal against gas or fluid migration along the wellbore. (Note that the term "second" is used merely for identification and does not require, and is not intended to imply, that the second seal is formed prior to formation of the first seal, positioned above or below the first seal, or provides a more or less effective seal than the first seal.) The swellable device 22 may provide additional mechanical support for suspension of the assembly in the casing, but this is not necessary.

The swellable annular sealing device 22 provides a redundant seal against gas migration after abandonment of the well.

Note that the tool assembly described herein does not employ a liner hung to the liner hanger. The "liner hanger" terminology is used despite this fact, since the method and apparatus presented herein utilize the expandable element in a plug and abandon capacity.

In operation, the swellable, annular sealing device 22 is positioned in a cased portion of the well. The actuating fluid, such as diesel, is circulated from the surface, through the tool string, through (or by) valve assembly 24, and into the wellbore annulus (the annular space defined between casing and tool assembly) through radial ports 44. End cap 26 covers the lower end of the valve assembly. The diesel is "spotted" around the end of the assembly, forming a balanced volume of diesel (or other actuating fluid) around the swellable sealing device. The diesel causes radial expansion of the swellable material and an annular seal is created. As is known in the art, an actuating fluid such as diesel can be pumped or circulated downhole by the operator.

Various techniques may be used for contacting or actuating the swellable material. An actuation fluid may already be present in the well when the swellable device is installed, or may be circulated through the well after installation in the well. The actuation fluid which causes swelling can be water and/or hydrocarbon fluid (such as oil, gas, diesel, etc.). In a preferred embodiment, the actuation fluid is a diesel fluid which is circulated into the well after positioning of the system in the wellbore. Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004/0020662, the entire disclosures of which are incorporated herein by this reference for all purposes. Further, swellable materials actuated by heat or introduction of a chemical composition have been developed and can be used as an alternate approach.

Figure 1G:
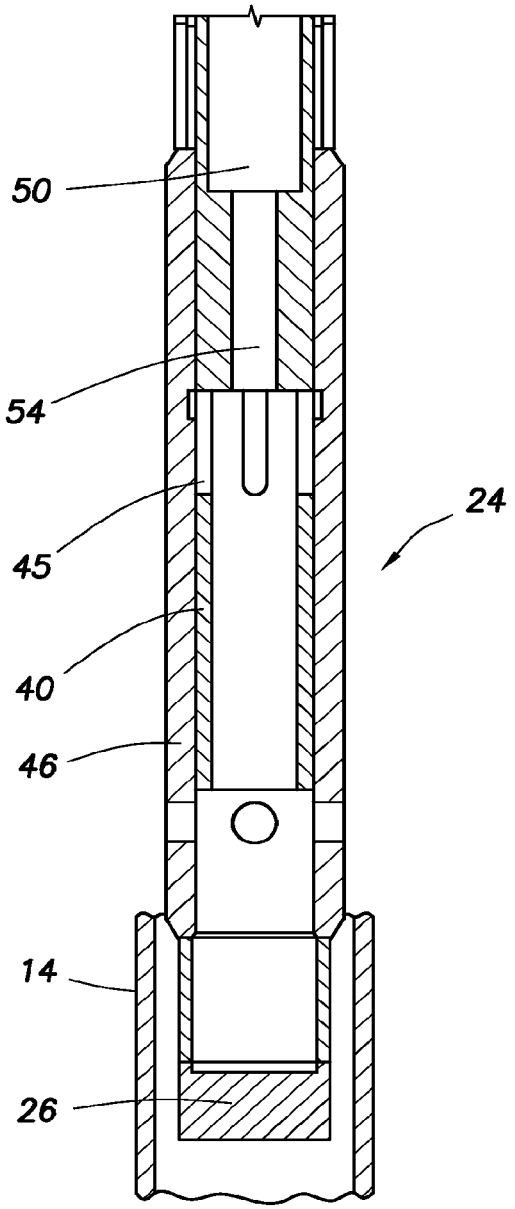
Figure 2G:
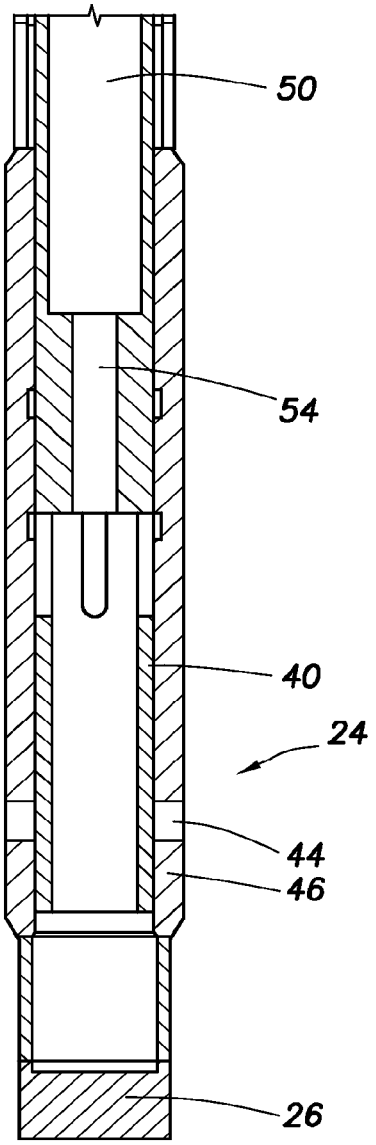

At or near the lower end of the assembly is the valve assembly 24 having, in a preferred embodiment, a sliding sleeve 40 movable between an open position, as seen in FIG. 1G, and a closed and locked position, as seen in FIG. 2G. In the open position, the valve sleeve 40 permits circulation of fluid between a fluid passageway 42 defined through the tool string and the wellbore annulus. It is noted that the fluid passageway 42 defined in the tool string can be a central passageway, as seen in the upper sub, swellable device and valve sleeve, or an annular or other passageway defined through the assembly elements. Cross-over tools can be used to flow fluid from central to annular passageways, as is known in the art. The sliding sleeve is preferably held in the open position by a selectively actuable holding mechanism 45, such as shear pins, shear ring, snap ring, and other such devices as are known in the art.

In use, the sliding sleeve 40 slides longitudinally in valve housing 46 from the open position to the closed position. The valve is preferably actuated by placing weight down on the tool string and shearing (or otherwise releasing) the holding mechanism 45. The valve sleeve 40 is operated by the lower mandrel end 55. The lower mandrel end 54 is shifted downward along with the mandrel 50, which, in turn, is moved by mandrel adapter 52, upon manipulation by the operator. Note that additional primary shear mechanisms can selectively lock the mandrel, setting sleeve, setting tool, etc., to each other or the liner hanger as is known in the art. The sliding sleeve is moved downward to a closed position. The sleeve can also be locked into the closed position, such as with a locking mechanism, for example, a lock ring, snap ring, one-way ratchet, collet, cooperating profiles, etc.

Alternate valve assemblies and configurations can be used and will be readily apparent to those of skill in art. For example, the valve can be actuated by rotational or longitudinal movement (in either direction), can be mechanically, electrically, hydraulically or otherwise actuated, and can be of various valve type (sliding sleeve, flapper, ball, etc.).

Releasable connector 32 of the setting sleeve is preferably a collet latch assembly selectively attaching the running tool assembly 18 to the liner hanger 20. Upon completion of the operational procedure, the collet is unlatched, preferably by placing weight down on the tool assembly. The collet assembly will not be discussed herein in detail as its operation and configuration are known in the art. For further disclosure regarding hydraulic set liner hangers, see U.S. Pat. No. 6,318,472, to Rogers, which is incorporated herein by reference for all purposes. Also see PCT Application PCT/US12/58242, to Stautzenberger, which is incorporated herein by reference in its entirety for all purposes. Further, other types of releasable connectors, such as retractable and/or extendable lugs, etc., can be used as are known in the art.

Figure 3:
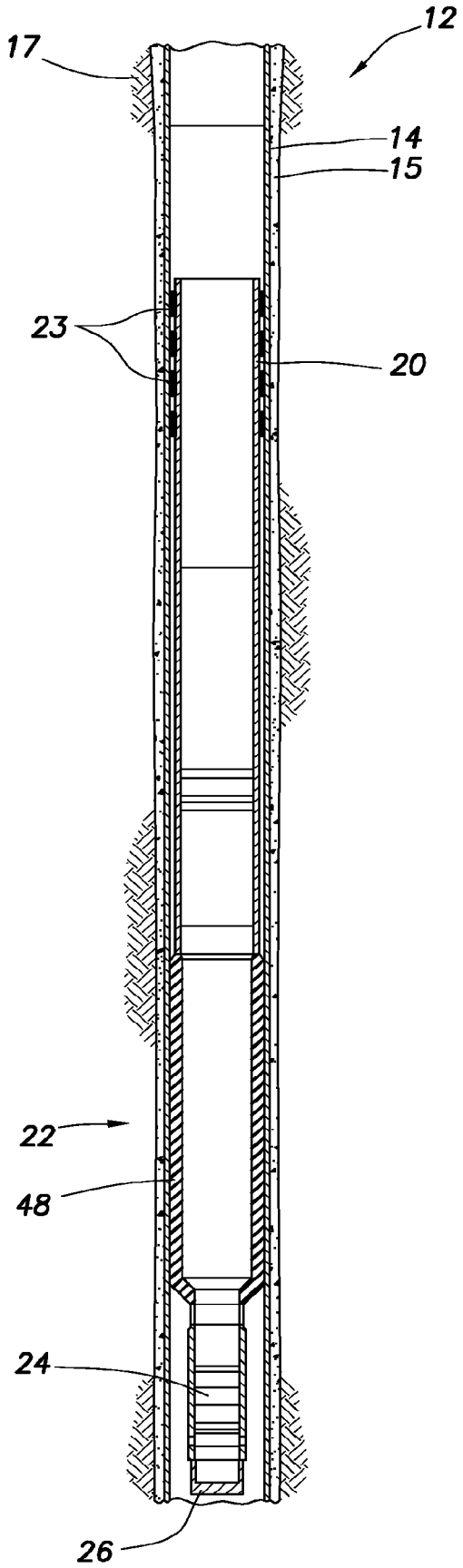
FIG. 3 is a schematic elevational view of a wellbore having the plugging assembly positioned therein according to an aspect of the invention.
Figure 4:
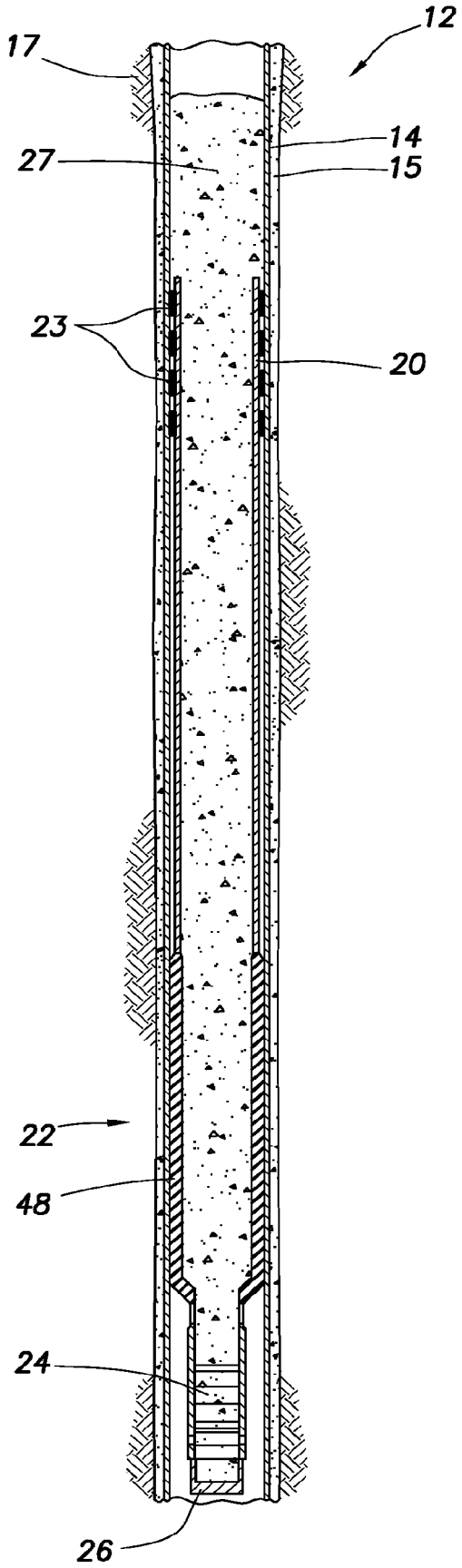
FIG. 4 is a schematic elevational view of the assembly in FIG. 3 with a cement plug positioned in the assembly.

FIG. 3 is a schematic elevational view of a wellbore having the plugging assembly positioned therein according to an aspect of the invention; and FIG. 4 is a schematic elevational view of the assembly with a cement plug positioned in the assembly.

In use, the tool string 10 is inserted to a desired location downhole in a wellbore 12 extending through a formation 17, the wellbore having a casing 14 positioned therein cemented 15 in place. The valve assembly 24, in an open position, allows fluid communication between the interior of the tool string and the annular space defined between the string and the casing. Diesel or another actuating fluid is circulated from the surface, through the tool string, and out of radial ports 44 extending through the valve housing 46. The actuating fluid flows along the annular space exterior the tool string and is spotted or volume-balanced about the swellable, annular sealing device 36. The actuating fluid actuates the swellable material sleeve 48. The swellable annular sealing device expands radially and creates a fluid-tight seal between the tool assembly and casing, thereby sealing against and preventing gas or fluid migration past the seal. The swellable material can expand before, during and/or after later-initiated method steps (such as setting of the liner hanger).

Subsequently, in the preferred embodiment, the setting tool 30 is actuated and the liner hanger set, such as by dropping a sealing ball (not shown) into the fluid passageway 42 in the string and, once the ball is seated, applying a hydraulic tubing pressure to actuate one or more piston assemblies or similar. The piston assemblies drive the expansion cone 31 longitudinally through the liner hanger 20, thereby radially expanding the liner hanger 20 into sealing engagement with the casing. The liner hanger 20 has annular sealing elements 23 mounted or positioned thereon which, upon radial expansion of the liner hanger, are moved into contact with the casing. The sealing elements 23 provide mechanical support for the liner hanger and suspended assemblies. The sealing elements of the expandable liner hanger create a fluid-tight seal between tool assembly and annulus, thereby sealing against and preventing gas or fluid migration past the seal elements.

An over-pull test can be performed to insure an effective anchoring of the expanded liner hanger to the casing. The running tool assembly is then released from the now-expanded liner hanger 20, preferably by placing weight down on the tool string, shearing any operable shear mechanisms, and longitudinally moving the mandrel 50 (and mandrel lower end 54) downward. The downward movement selectively unlatches releasable connection assembly 32, preferably a collet latching assembly, thereby releasing the running tool from the liner hanger. If shear mechanisms are provided at the valve assembly, these are sheared as well. The mandrel moves the valve element 48 from an open to a closed position wherein fluid is blocked from flowing through ports 44 and into the wellbore annulus. The running tool assembly is then pulled out of hole, leaving positioned in the wellbore the expanded liner hanger, swellable sealing device, valve assembly and end cap as seen in FIG. 3.

A cementing procedure is run, as is known in the art, placing cementing material 27 into the wellbore at the liner hanger and creating an effective plug. Cement preferably substantially fills the valve assembly, swellable sealing device, and liner hanger, as seen in FIG. 4. The well is now plugged and can be abandoned. Gas and fluid leakage and migration past the expandable liner hanger annular seals and the swellable annular sealing device is prevented.

If deflection of the casing occurs after completion of the plugging and abandonment operations, it is anticipated that the swellable material of the swellable annular sealing device will deform to maintain an effective seal and prevent gas or fluid leakage or migration uphole.

Exemplary methods of use of the invention are described, with the understanding that the invention is determined and limited only by the claims. Those of skill in the art will recognize additional steps, different order of steps, and that not all steps need be performed to practice the inventive methods described.

In preferred embodiments, the following method steps are disclosed, where the steps listed are not exclusive, can be performed simultaneously or sequentially, can be performed in any order, can be combined in any alternate orders (i.e., steps XYZ can be performed as XZY, YXZ, YZX, ZXY, etc.) (unless otherwise indicated), and wherein the order and performance of the steps is disclosed additionally by the claims appended hereto, which are incorporated by reference in their entirety into this specification for all purposes (including support of the claims) and/or which form a part of this specification, the method steps presented in the following text. A method for plugging and abandoning a subterranean wellbore having a casing positioned therein is presented, wherein the method comprises combinations of the following steps: running a tool string into the wellbore, the tool string having a swellable annular sealing device, and an expandable liner hanger with at least one annular sealing element mounted thereon; radially expanding the swellable annular sealing device; creating a fluid-tight annular seal between the swellable annular sealing device and the casing; radially expanding the expandable liner hanger and contacting the casing with the at least one annular sealing element; and creating a fluid-tight annular seal between the expandable liner hanger and the casing; wherein the step of running in the tool string can further comprise running in an expansion tool releasably attached to the expandable liner hanger; wherein the step of radially expanding the expandable liner hanger can further comprise the step of driving an expansion element of the expansion tool through the expandable liner hanger; releasing the expandable liner hanger and swellable annular sealing device from the tool string; releasing a collet latch assembly releasably connecting the expandable liner hanger to the expansion tool; wherein the step of releasing the expandable liner hanger from the tool string can further comprise the step of placing weight down on the tool string; wherein the step of radially expanding the swellable annular sealing device can further comprise the step of exposing a swellable material positioned on the device to an actuating fluid, an actuating chemical, or to heat; flowing an actuating fluid downhole; further comprising the step of flowing the actuating fluid through the tool string, through a valve attached to the tool string, and through valve ports into a wellbore annulus defined between the swellable annular sealing device and the casing; wherein the step of running the tool string into the wellbore can further comprise the step of running a valve into the wellbore, the valve in an open position and allowing fluid communication between the interior of the tool string and the wellbore annulus; closing the valve and blocking fluid communication between the tool string interior and the wellbore annulus; locking the valve in a closed position; wherein the valve comprises a sliding sleeve valve; wherein the step of closing the valve can further comprise placing weight down on the tool string; pulling the tubing string out of hole and leaving the swellable annular sealing device and expandable liner hanger in the wellbore; after radially expanding the expandable liner hanger, positioning a cementing material in the expandable liner hanger; deforming the swellable annular sealing device in response to seismic events such that the fluid-tight annular seal between the swellable annular sealing device and the casing remains fluid-tight; wherein the step of driving the expansion element can further comprise the step of increasing tubing pressure to effectuate the driving of the expansion element.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

What is claimed is:

1. A method for plugging and abandoning a subterranean wellbore having a casing positioned therein, the method comprising the steps of:

running a tool string into the wellbore, the tool string having a swellable annular sealing device, an expandable liner hanger with at least one annular sealing element mounted thereon, and a valve in an open position to allow fluid communication between the interior of the tool string and a wellbore annulus defined between the swellable annular sealing device and the casing;

radially expanding the swellable annular sealing device;

creating a fluid-tight annular seal between the swellable annular sealing device and the casing;

radially expanding the expandable liner hanger and contacting the casing with the at least one annular sealing element;

creating a fluid-tight annular seal between the expandable liner hanger and the casing, wherein the step of radially expanding the swellable annular sealing device further comprises the step of exposing a swellable material positioned on the device to an actuating fluid, an actuating chemical, or to heat; and closing the valve after creating a fluid-tight annular seal between the expandable liner hanger and the casing to block fluid communication between the interior of the tool string and the wellbore annulus.

2. The method of claim 1, further comprising the step of flowing an actuating fluid downhole while the valve is in the open position.

3. The method of claim 2, further comprising the step of flowing the actuating fluid through the tool string, through the valve attached to the tool string, and through valve ports into the wellbore annulus.

4. The method of claim 1, further comprising the step of locking the valve in a closed position.

5. The method of claim 3, wherein the valve comprises a sliding sleeve valve.

6. The method of claim 1, wherein the step of closing the valve further comprises placing weight down on the tool string.

7. A system for plugging and abandoning a subterranean wellbore having a casing positioned therein, the system comprising:

an expandable liner hanger having at least one annular sealing element mounted thereon for creating a fluid-tight annular seal between the expandable liner hanger and the casing;

the expandable liner hanger releasably attached to a liner hanger running tool having an expansion assembly for radially expanding the expandable liner hanger into sealing contact with the casing, an expansion drive assembly for driving the expansion assembly, and a selectively operable release mechanism for releasing the liner hanger running tool from the expandable liner hanger;

a swellable annular sealing device having a swellable material mounted thereon; and a selectively operable bottom valve having a valve element movable from an open position, wherein fluid is communicable between a fluid passageway defined in the system and a casing annulus defined between the system and the casing, to a closed position, wherein such fluid communication is blocked, the bottom valve for selectively allowing delivery of an actuation fluid for actuating the swellable material to the casing annulus.

8. The system of claim 7, wherein at least one of the expandable liner hanger, swellable annular sealing device, or bottom valve, is configured to substantially fill with cementing material after release of the liner hanger from the liner hanger running tool and pulling the running tool out of hole.

9. The system of claim 7, wherein the swellable annular sealing device is a swell packer and wherein the swellable material is actuated by a water-based or diesel-based fluid.

10. The system of claim 7, wherein the selectively operable release mechanism is actuated by placing weight down on the system, and wherein the bottom valve is moved to the closed position by placing weight down on the system.

* * * * *